US010544017B2

(12) United States Patent
Hall et al.

(10) Patent No.: US 10,544,017 B2
(45) Date of Patent: Jan. 28, 2020

(54) WINCH WITH ONE-WAY REVERSE TENSIONER

(71) Applicants: David R. Hall, Provo, UT (US); Jerome Miles, Spanish Fork, UT (US); Daniel Madsen, Vineyard, UT (US); Benjamin Taylor, Orem, UT (US)

(72) Inventors: David R. Hall, Provo, UT (US); Jerome Miles, Spanish Fork, UT (US); Daniel Madsen, Vineyard, UT (US); Benjamin Taylor, Orem, UT (US)

(73) Assignee: Hall Labs LLC, Provo, UT (US)

( * ) Notice: Subject to any disclaimer, the term of this patent is extended or adjusted under 35 U.S.C. 154(b) by 388 days.

(21) Appl. No.: 15/234,611

(22) Filed: Aug. 11, 2016

(65) Prior Publication Data

US 2018/0044151 A1 Feb. 15, 2018

(51) Int. Cl.
*B66D 1/38* (2006.01)
*B66D 1/36* (2006.01)

(52) U.S. Cl.
CPC ..... *B66D 1/38* (2013.01); *B66D 1/365* (2013.01); *B66D 2700/0108* (2013.01); *B66D 2700/0191* (2013.01)

(58) Field of Classification Search
CPC .. B66D 1/38; B66D 1/365; B66D 2700/0108; B66D 2700/0191
See application file for complete search history.

(56) References Cited

U.S. PATENT DOCUMENTS 1,973,446 A * 9/1934 Resenquist ..... B66D 1/38 242/483
2,595,655 A * 5/1952 Hannay ..... B65H 75/38 137/355.2
2,926,867 A * 3/1960 Nardone ..... B66D 1/36 242/397.3
3,024,001 A * 3/1962 Worden ..... B66D 1/39 242/399
6,435,447 B1 * 8/2002 Coats ..... B65H 54/2848 242/157.1
6,811,112 B1 * 11/2004 Currie ..... B65H 54/2872 242/157.1
7,478,795 B2 * 1/2009 Grapes ..... B66D 3/02 254/333
7,621,508 B2 * 11/2009 Wagner ..... F16G 13/07 254/372
9,440,817 B2 * 9/2016 Zink ..... B65H 75/38
2001/0008279 A1 * 7/2001 Kiviniitty ..... B66D 1/30 254/335
2005/0087644 A1 * 4/2005 Kim ..... B65H 75/425 242/390.8
2011/0193037 A1 * 8/2011 Smith ..... B66D 1/38 254/336

(Continued)

*Primary Examiner* — Michael E Gallion

(57) ABSTRACT

A winch is described that includes a drum, a motor and transmission, and a tensioner. The motor and transmission apply torque to the drum, thereby enabling the drum to draw in and let out a line. The tensioner is positioned adjacent to the drum, such that when the line passes between the tensioner and drum, the line is in frictional contact with the tensioner and drum. The tensioner rotates with a linear speed exceeding a linear speed of the drum as the line is let out from the drum, and rotates freely as the line is drawn onto the drum. Methods for making and using the winch are also described.

14 Claims, 11 Drawing Sheets

(56) References Cited

U.S. PATENT DOCUMENTS

| | | | | |
|---|---|---|---|---|
| 2012/0048152 | A1* | 3/2012 | Kim | B66D 1/39<br>108/20 |
| 2013/0187105 | A1* | 7/2013 | Xydias | B66D 1/30<br>254/277 |
| 2015/0284223 | A1* | 10/2015 | Hall | B66D 1/38<br>254/333 |
| 2017/0240391 | A1* | 8/2017 | Hall | B66D 1/30 |
| 2017/0253469 | A1* | 9/2017 | Hall | B66D 1/30 |
| 2018/0050892 | A1* | 2/2018 | Hall | B66D 1/12 |
| 2018/0105404 | A1* | 4/2018 | Hall | B66D 1/38 |

* cited by examiner

WINCH WITH ONE-WAY REVERSE TENSIONER

TECHNICAL FIELD

This invention relates generally to the field of winches and hoists.

BACKGROUND

Ah, the winch: a tried and true tool indispensable in so very many applications! Be it pulling a Jeep from the mud, hoisting a 454 out of a classic Chevy, or simply tightening down a heavy load, the winch has been an enduring marvel of fundamental engineering. The sheer magnitude of the winch's usefulness has made problems with its use seem miniscule in comparison, enough so that these problems have been left unresolved for as long as the winch has been an implement. Take, for example, the simple issue of paying out a line. In many instances, the line is a sturdy rope that, when paying out, tends to back up on the drum, resulting in an unnavigable rat's nest, and thereby rendering the winch useless for anything but a bludgeon. Similarly, when a force is exerted on the line in the direction of the drum as the line is paying out, veritable chaos ensues. The solution so often implemented has been simply to pull on the line as it pays out. However, in so many applications, this is impractical, if not utterly impossible. Therefore, there is at least one problem with winch-tech that, having been left unresolved, accordingly leaves the winch in a lesser state than it could possess.

SUMMARY OF THE INVENTION

A winch is disclosed herein that overcomes the limitations discussed above. In general, the winch includes a tensioning mechanism that ensures a line paying out from the winch stays tight on the winch, avoiding loosening of the line from the winch and the subsequent tangling that occurs. In one embodiment, a winch is described that includes a drum, a motor and transmission, and a tensioner. The motor and transmission apply torque to the drum, thereby enabling the drum to draw in and let out a line. The tensioner is positioned adjacent to the drum, such that when the line passes between the tensioner and drum, the line is in frictional contact with the tensioner and drum. The tensioner rotates with a linear speed exceeding a linear speed of the drum as the line is let out from the drum, and rotates freely as the line is drawn onto the drum.

In another embodiment of the claimed invention, a method of using a winch is described. The method includes providing a winch, providing a line, and causing the winch to rotate. The winch includes a drum that draws in and lets out a line, a motor and transmission that apply torque to the drum, and a tensioner positioned adjacent to the drum. The tensioner is positioned such that when the line passes between the tensioner and drum, the line is in frictional contact with the tensioner and drum. Additionally, the tensioner rotates with a linear speed exceeding a linear speed of the drum as the line is let out from the drum, and rotates freely as the line is drawn in. In providing the line, the line passes between the tensioner and the drum.

In yet another embodiment, a method of making a winch is also described. The method includes providing a drum, coupling a motor and transmission to the drum, and coupling a tensioner to the drum. The motor and transmission apply torque to the drum, and a line passes between the tensioner and drum such that the line is in frictional contact with the tensioner and drum. The tensioner is also coupled to the drum, such that the tensioner rotates with a linear speed exceeding a linear speed of the drum as the line is let out from the drum, and such that the tensioner rotates freely as the line is drawn onto the drum.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and are not intended to limit the described elements to only the features described with regard to the other embodiments. Rather, each embodiment is distinct from each other embodiment.

Throughout the detailed description, various elements are described as "off-the-shelf." As used herein, "off-the-shelf" means "pre-manufactured" and/or "pre-assembled."

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch+/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

Figure 1A:
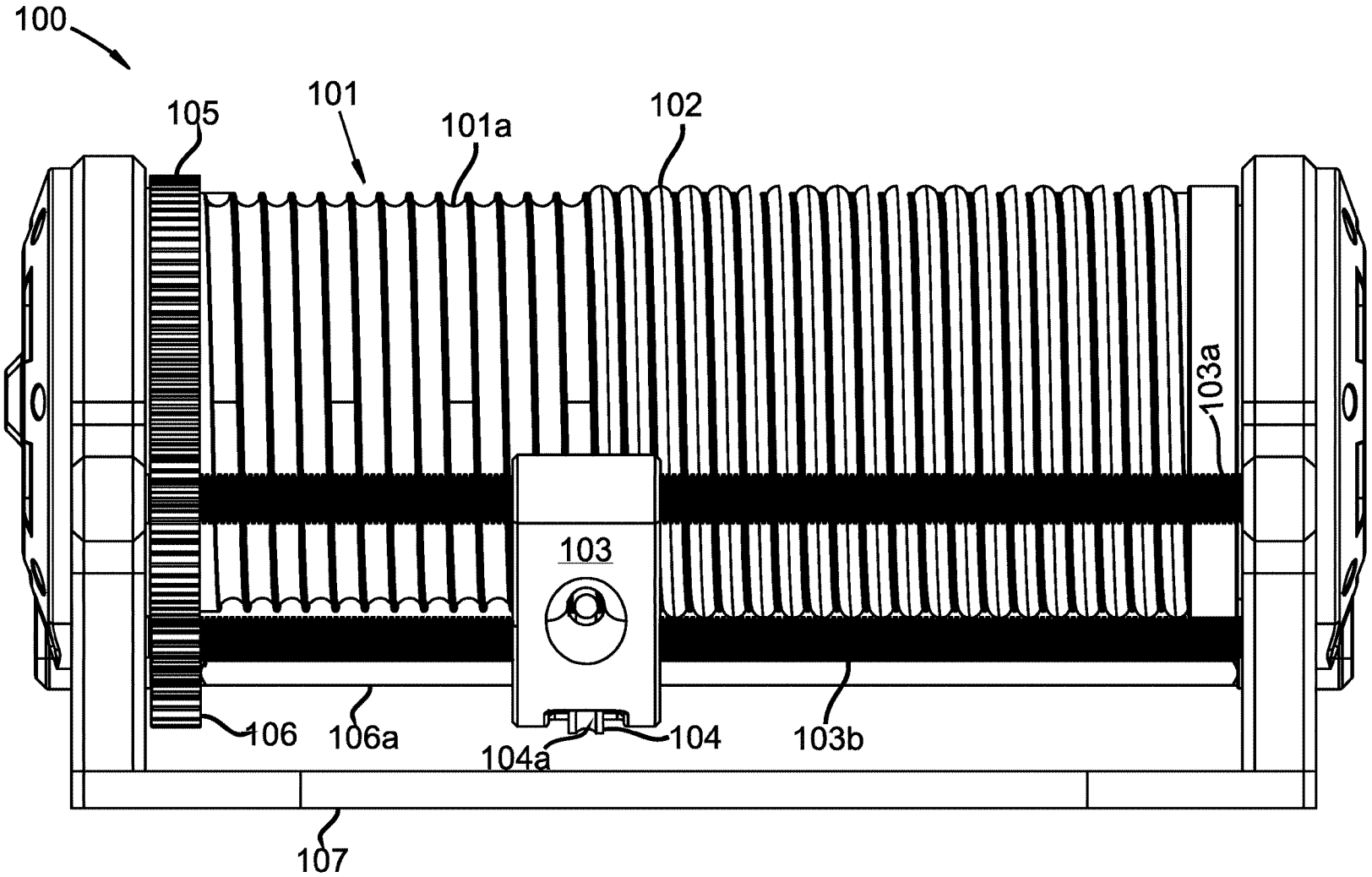
FIGS. 1A-B depict two views of a winch according to the claimed invention.
Figure 1B:
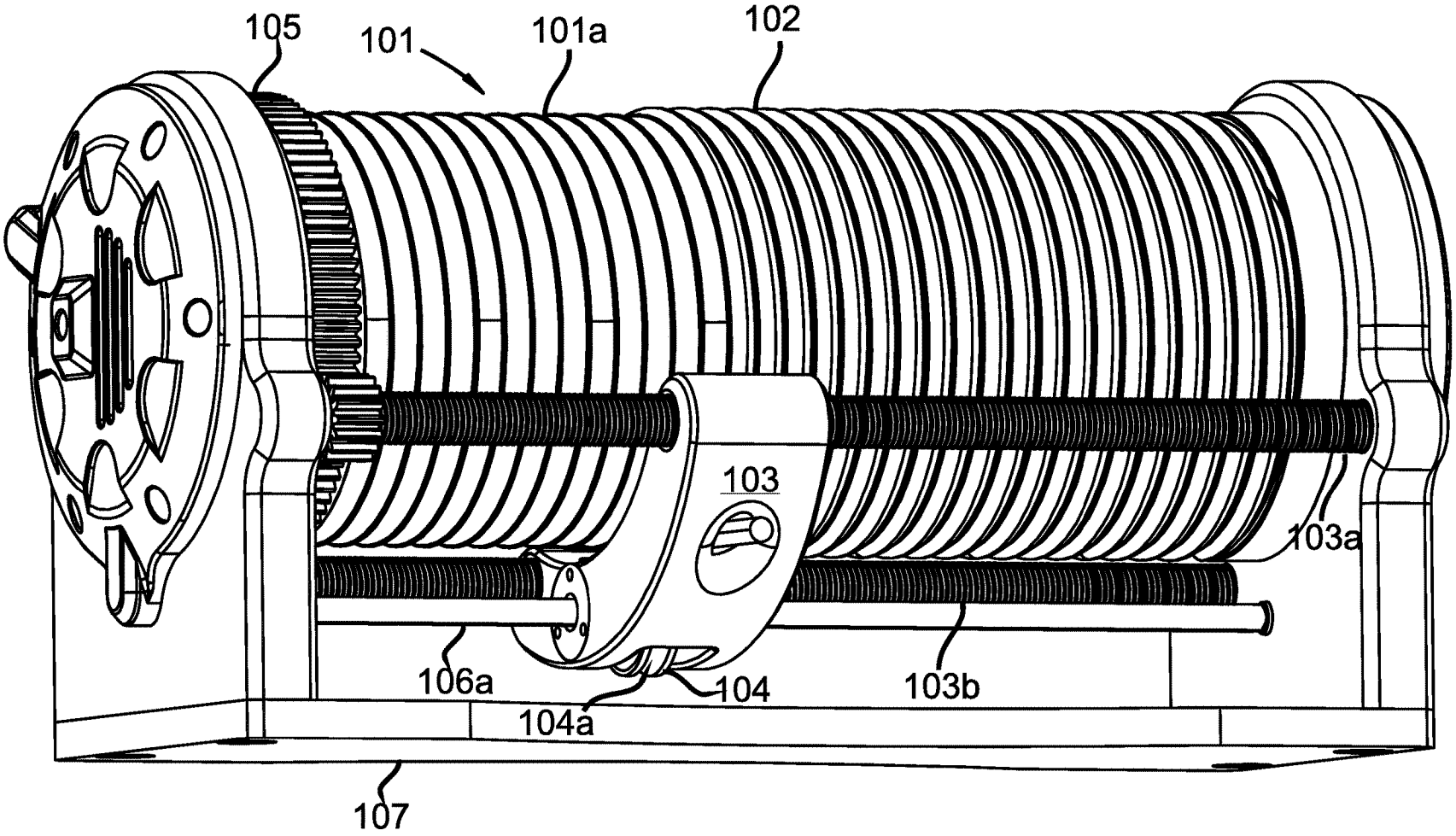
Figure 3:
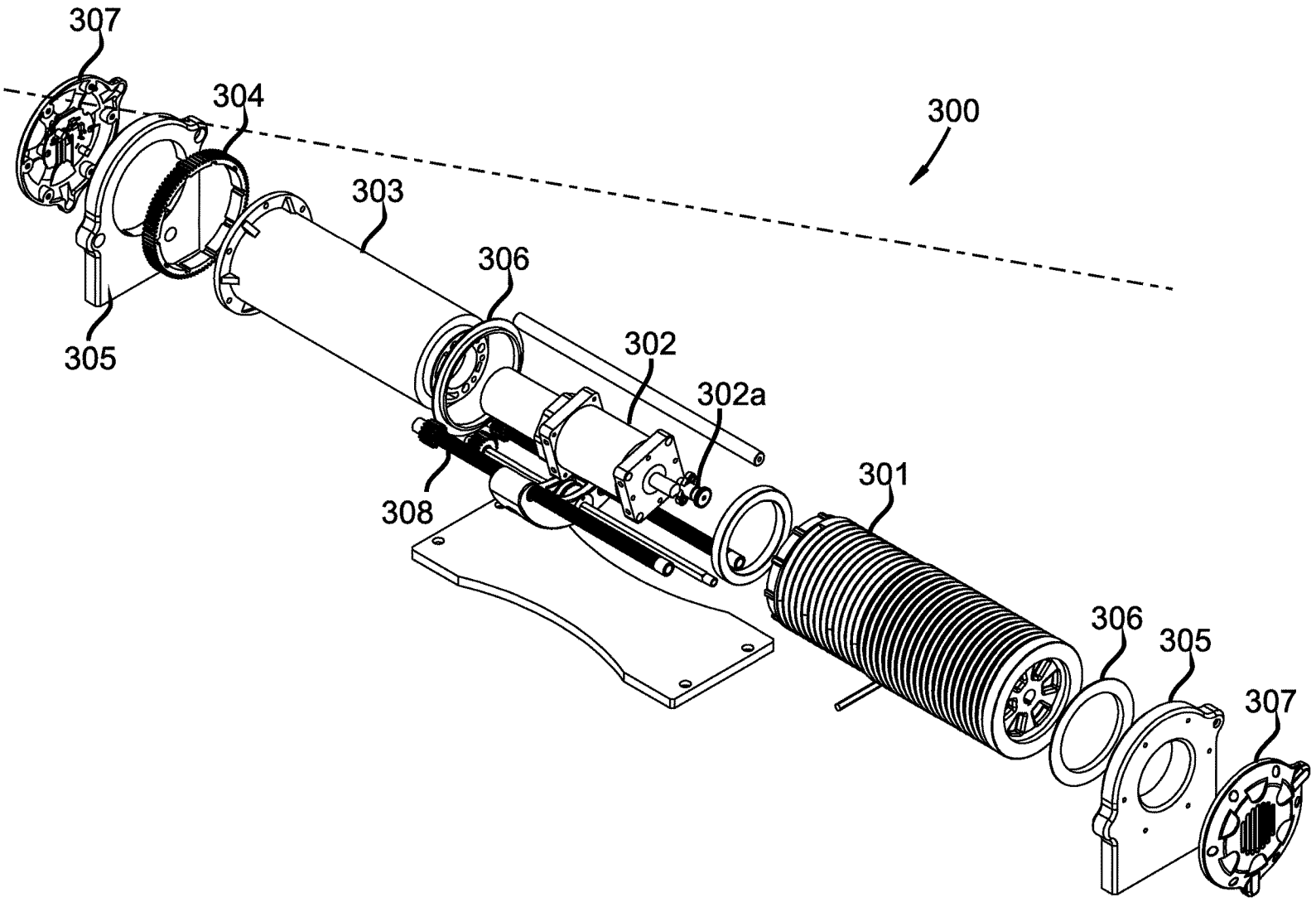
FIG. 3 depicts an exploded view of a winch according to the claimed invention.

FIGS. 1A-B depict two views of a winch according to the claimed invention. Winch 100 includes drum 101, line 102, line guide 103, tensioner 104, drum gear 105, tensioner gear 106, and mount 107. Additionally, though not shown, in some embodiments, winch 100 includes a motor and transmission disposed at least partially within drum 101. In other embodiments, the motor and transmission are disposed adjacent to drum 101. In the depicted embodiment, however, the motor and transmission are disposed completely within drum 101 (and therefore not visible, but as shown in FIGS. 3 and 4B). The motor and transmission apply torque to drum 101 and enable drum 101 to draw in and let out line 102. Tensioner 104 is positioned adjacent to drum 101 such that when line 102 passes between tensioner 104 and drum 101, line 102 is in frictional contact with tensioner 104 and drum 101. Additionally, tensioner 104 rotates with a linear speed exceeding a linear speed of drum 101 as line 102 is let out from drum 101, and rotates freely as line 102 is drawn onto drum 101.

Drum 101 is, in many embodiments, a right circular cylindrical drum. However, in some embodiments, drum 101 is any of a variety of cylindrical shapes, such as an elliptic cylinder, a parabolic cylinder, a hyperbolic cylinder, and/or an oblique cylinder. In yet other embodiments, drum 101 is a cuboid, a rounded cuboid, a triangular prism, and/or any of a variety of other polyhedral shapes. Additionally, in some embodiments, drum 101 is hollow, such as in embodiments where the motor and transmission are positioned within drum 101. In other embodiments, drum 101 is partially hollow or completely solid. Additionally, as depicted, in some embodiments, drum 101 includes helical groove 101*a* that guides line 102 as line 102 is wound onto drum 101.

Line 102 winds around drum 101, and is any of a variety of off-the-shelf lines compatible with use on a winch, such as nylon, polypropylene, polyester, UHMWPE, aramid, cotton, Kevlar, steel cable, and/or coated steel cable, among others. Additionally, in some embodiments, line 102 is a rope, whereas in other embodiments line 102 is a strap. In some embodiments line 102 comprises a wear-resistant material sufficient to withstand wear from tensioner 104 for longer than a service life of line 102. As used herein, "service life" refers to a number of uses of a line before line 102 frays or otherwise deteriorates from load-bearing that the line can no longer sustain loads for which the line is useful and/or the winch can tolerate. In some embodiments, the line comprises a tribological material having a coefficient of friction greater than 1.

Line guide 103 guides line 102 as line 102 pays out from, and is drawn onto, drum 101. In some embodiments, line guide 103 is coupled to drum 101 by threaded rods 103*a*, 103*b*. Threaded rods 103*a*, 103*b* enable line guide 103 to accurately spool line 102 onto drum 101. In other embodiments, line guide 103 slides along smooth rods and assists grooves 101*a* in spooling line 102.

Tensioner 104 includes, in the depicted embodiment, a wheel positioned in line guide 103. However, tensioner 104 includes, in other embodiments, any of a variety of shapes sufficient for providing payout tension to line 102 as line 102 is payed-out from drum 101. The payout tension causes line 102 to remain firmly wrapped around drum 101 as it is payed-out so that it does not back up on drum 101 and cause the rest of line 102 on drum 101 to loosen and, in some cases tangle. Thus, in some embodiments, tensioner 104 includes a sphere or a belt. In other embodiments, tensioner 104 includes teeth that bite into line 102. In some embodiments, such as the depicted embodiment, tensioner 104 includes groove 104*a* that fits around line 102 to provide greater surface area for frictional contact between tensioner 104 and line 102.

Drum gear 105 approximately matches a diameter of drum 101, and is positioned to engage tensioner gear 106. In some embodiments, drum gear 105 is integrally incorporated into drum 101, and is manifested as teeth protruding from drum 101. In other embodiments, such as the depicted embodiment, drum gear is a separate component coupled to drum 101. This is beneficial in cases where drum gear 105 gets stripped and needs to be replaced; drum gear 105 is replaceable without having to replace the entire drum 101. Tensioner gear 106 is coupled to tensioner 104 by tensioner rod 106*a*. As depicted, tensioner gear 106 has a smaller diameter than drum gear 105. In various embodiments, the gear ratio between tensioner gear 106 and drum gear 105 ranges from 1.1 turns of the tensioner gear for every 1 turn of the drum gear, to 100 turns of the gear ratio for every 1 turn of the drum gear. For example, in some embodiments, the tensioner gear to drum gear ratio ranges from 1.1:1 to 25:1. 25:1 to 50:1, 50:1 to 75:1, and/or 75:1 to 100:1. Ranges in other embodiments also include 1.1:1 to 10:1, 10:1 to 20:1, 20:1 to 30:1, 30:1 to 40:1, 40:1 to 50:1, 50:1 to 60:1, 60:1 to 70:1, 70:1 to 80:1, 80:1 to 90:1, and/or 90:1 to 100:1. For example, in one embodiment, the gear ratio is 6:1, in another it is 40:1, and in yet another it is 47:1. Additionally, in the depicted embodiment, drum gear 105 rotates at a same speed as drum 101, and tensioner gear 106 rotates at a same speed as tensioner 104. However, in other embodiments, further gear reduction occurs. For example, in one embodiment, a diameter of tensioner 104 is larger than the diameter of tensioner gear 106, and tensioner 104 rotates with a higher linear speed than tensioner gear 106. Similarly, in some embodiments, drum gear 105 is smaller than drum 101, and rotates at a lower linear speed than drum 101. Alternatively, in some embodiments, drum gear 105 includes a set of planetary gears.

Mount 107 mounts winch 100 to any of a variety of surfaces in any of a variety of orientations, such as horizontal, vertical, right-side up, and upside down. Thus, mount 107 is made of any of a variety of materials sufficient to withstand torque created by winch 100 bearing a load and, in some cases, additional torque caused by gravity. In some embodiments, mount 107 is a steel and/or aluminum alloy. In other embodiments, mount 107 is a hardened and/or thermoset plastic, such as nylon, acrylic, HDPE, and/or melamine.

Figure 2:
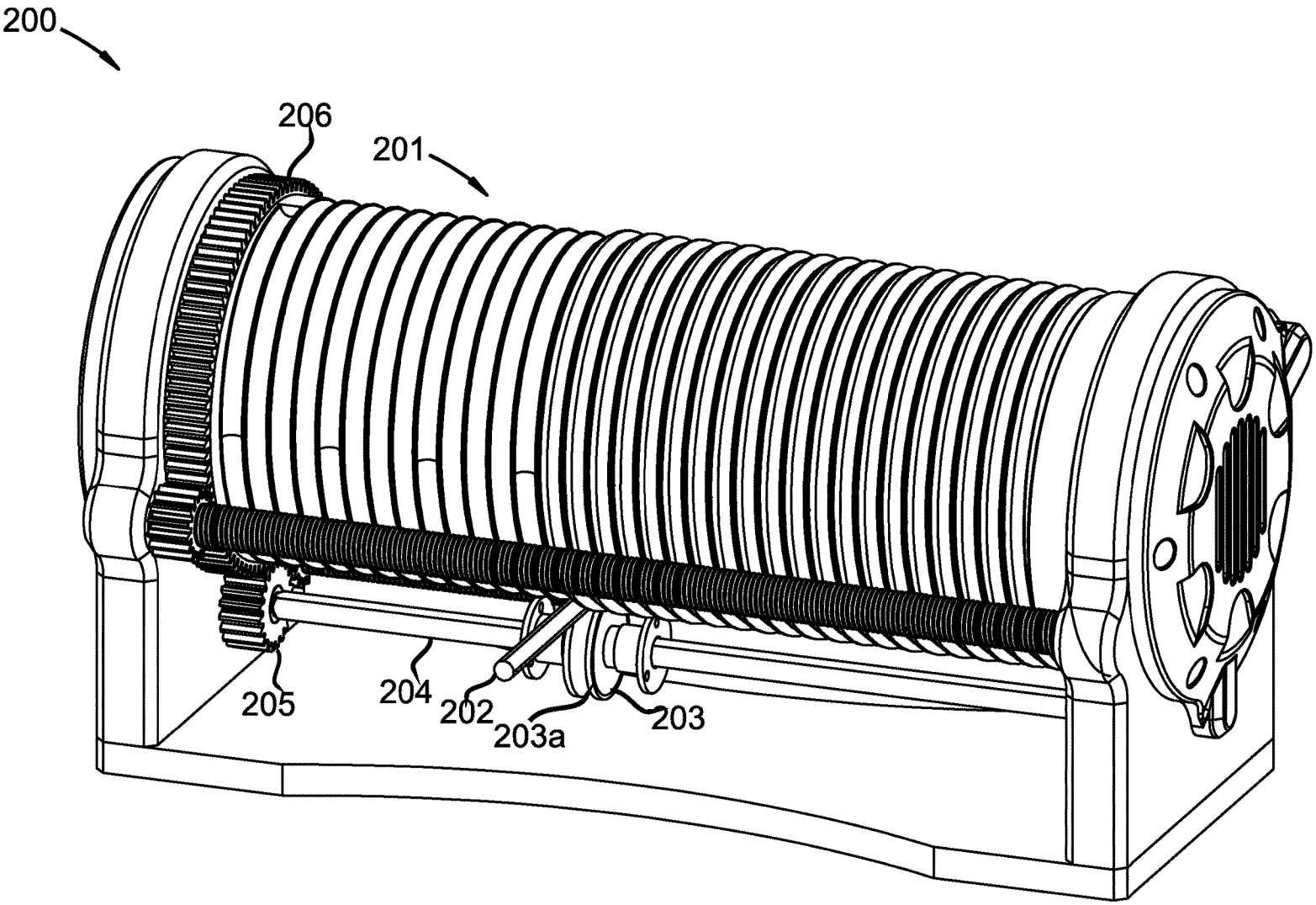
FIG. 2 depicts a winch with the line guide removed to display the tensioner.

FIG. 2 depicts a winch with the line guide removed to display the tensioner. Winch 200 includes drum 201, line 202, and tensioner 203. As shown, and similar to that described above with regard to FIG. 1, tensioner 203 includes groove 203*a*, and is coupled to drum 201 via tensioner rod 204, tensioner gear 205, and drum gear 206.

FIG. 3 depicts an exploded view of a winch according to the claimed invention. Winch 300 includes drum 301, motor 302 and transmission 302*a*, motor housing 303, drum gear 304, mounts 305, rings 306, and end caps 307. Motor 302 rotates drum 301 via transmission 302*a*. Motor 302 is any of a variety of AC and/or DC electric motors. Similarly, motor 302 is powered in any of a variety of ways. In some embodiments, motor 302 includes a 110V power cord that powers motor 302 via mains electricity. In other embodiments, motor 302 is a high-powered winch that requires a 220V line. In some embodiments, though, motor 302 is powered by any of a variety of off-grid sources, such as a battery and/or solar cells. Motor 302 is contained within housing 303, which shields motor 302 from rotating drum 301 and fixes motor 302 to mounts 305 so that motor 302 can transfer power to drum 301.

As in previously described embodiments, drum 301 is coupled to drum gear 304, which drives one or more of threaded guide rods 308 and the tensioner (not visible in this view, but as depicted in FIGS. 1A-2). Rings 306 fit around the ends of drum 301 and into mounts 305, allowing drum 301 to rotate in mounts 305. In some embodiments, mounts 305 include bearings. In other embodiments, rings 306 include bearings. End caps 307 enclose the other components of winch 300 and, in some embodiments, such as the depicted one, allow for ventilation of motor 302. Additionally, in some embodiments, at least one endcap 307 holds electronic controls for motor 302.

Figure 4A:
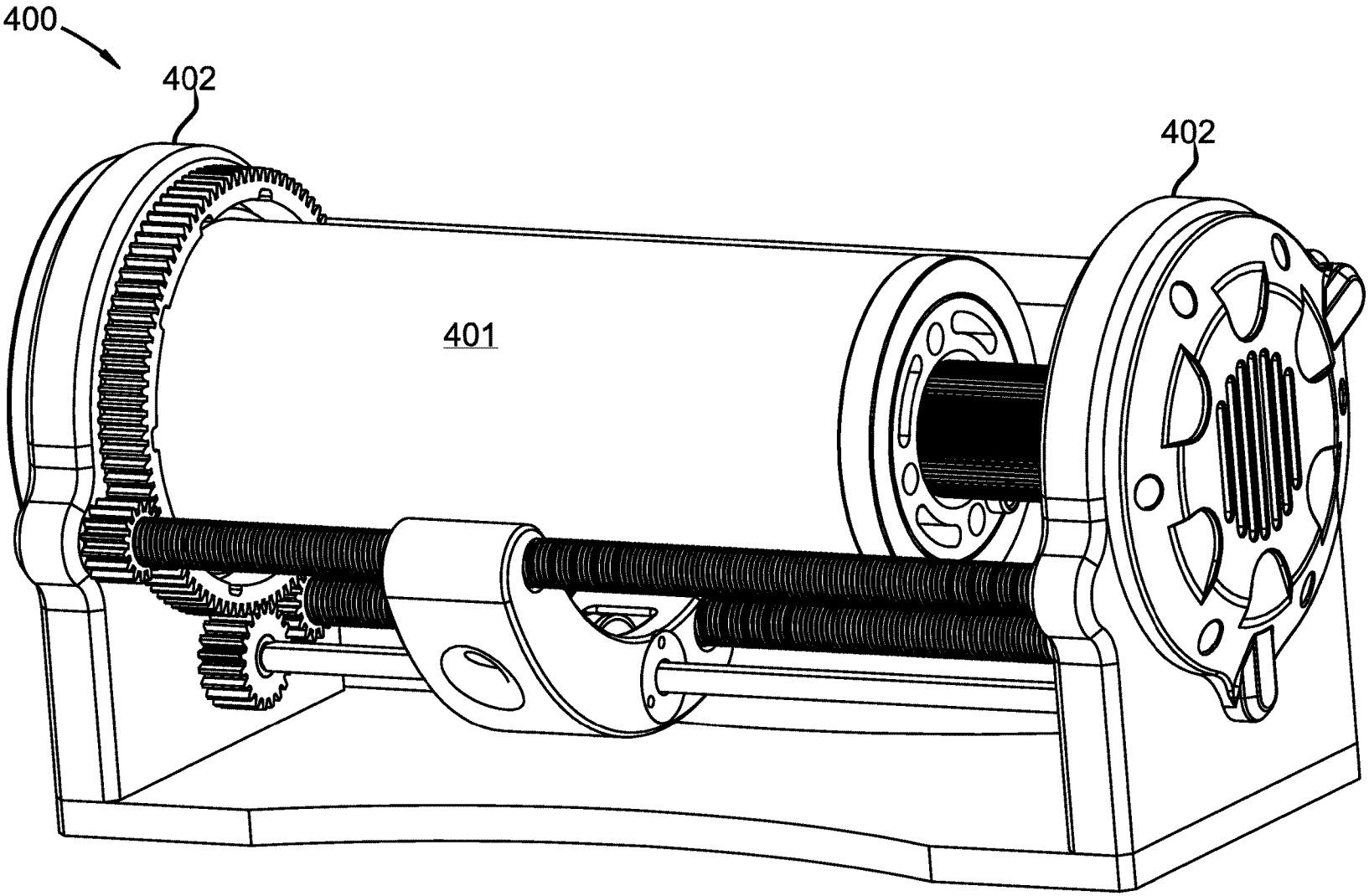
FIGS. 4A-B depict isometric views of internal components of a winch according to the claimed invention.
Figure 4B:
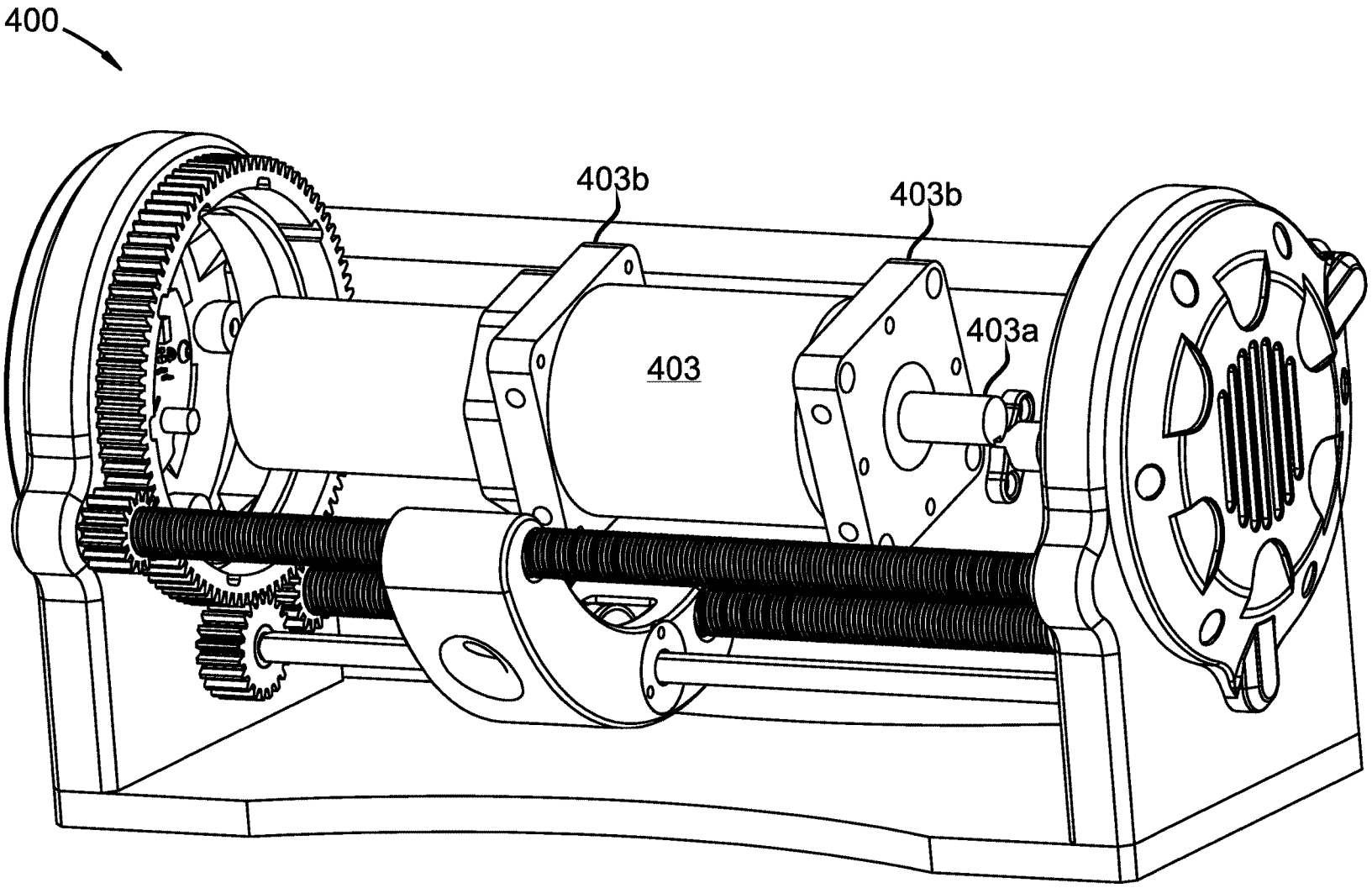

FIGS. 4A-B depict isometric views of internal components of a winch according to the claimed invention. As shown in FIG. 4A, Motor housing 401 is coupled to mount 402 of winch 400. Motor housing 401 is stationary, and allows motor 403, shown in FIG. 4B, to transfer power to a drum (such as is depicted and described with regard to FIGS. 1A-3). Transmission 403*a* transfers power from motor 403 to the drum, and motor mounts 403*b* couple motor 403 to housing 401.

Figure 5:
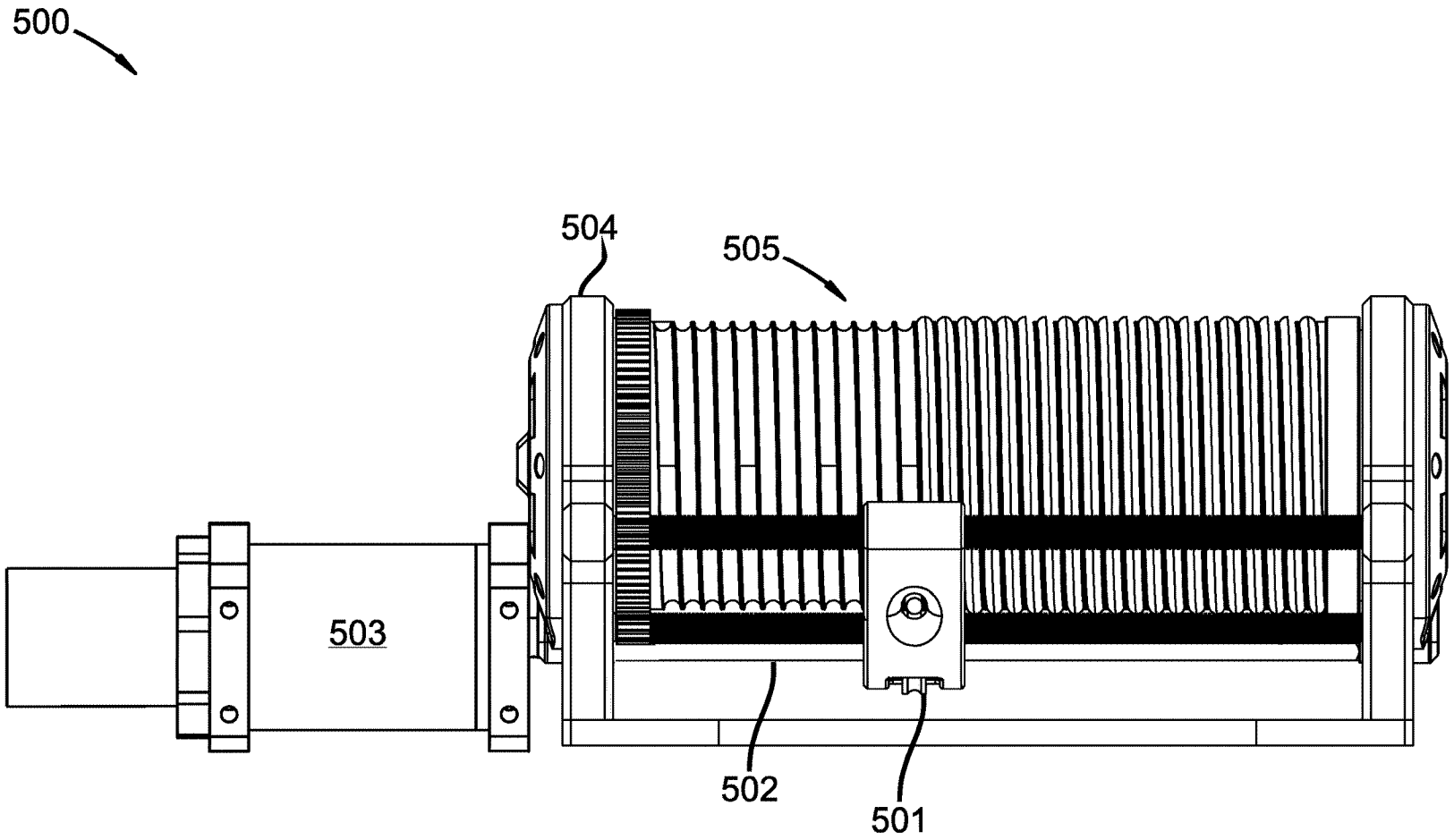
FIG. 5 depicts a winch with an external motor that powers a tensioner.

FIG. 5 depicts a winch with an external motor that powers a tensioner. Winch 500 includes tensioner 501, tensioner rod 502, and tensioner motor 503. Tensioner motor 503 drives tensioner 501 via tensioner rod 502. Similar to that described above with regard to motor 302, tensioner motor 503 is any of a variety of AC and/or DC electric motors. Similarly, motor 503 is powered in any of a variety of ways. In some embodiments, motor 503 includes a 110V power cord that powers motor 503 via mains electricity. In other embodiments, motor 503 coupled to the winch motor, and is powered in the same way the winch motor is powered. However, in some embodiments, motor 503 is powered by any of a variety of off-grid sources, such as a battery and/or solar cells. Motor 503 is fixed to mount 504, which allows motor 503 to transfer power to tensioner 501.

In embodiments that include motor 503, the winch motor and motor 503 communicate such that motor 503 always rotates tensioner 501 with a greater linear speed than a payout speed of a winch line (such as is depicted with regard to FIGS. 1A-2). For example, in one embodiment, motor 503 includes a microcontroller that is wired to a winch motor microcontroller. The winch motor microcontroller reads a rotation rate of drum 505 and communicates the rotation rate to the motor 503 microcontroller. The motor 503 microcontroller has stored a diameter of drum 505 and a diameter of tensioner 501, and uses the rotation rate of drum 505 to determine a rotation rate of tensioner 501 that results in a linear speed of tensioner 501 greater than the payout speed. The linear speed calculation accounts for variation in payout speed caused by line diameter variations so that, regardless of any line diameter variations, the linear speed is always greater than the payout speed.

Figure 6:
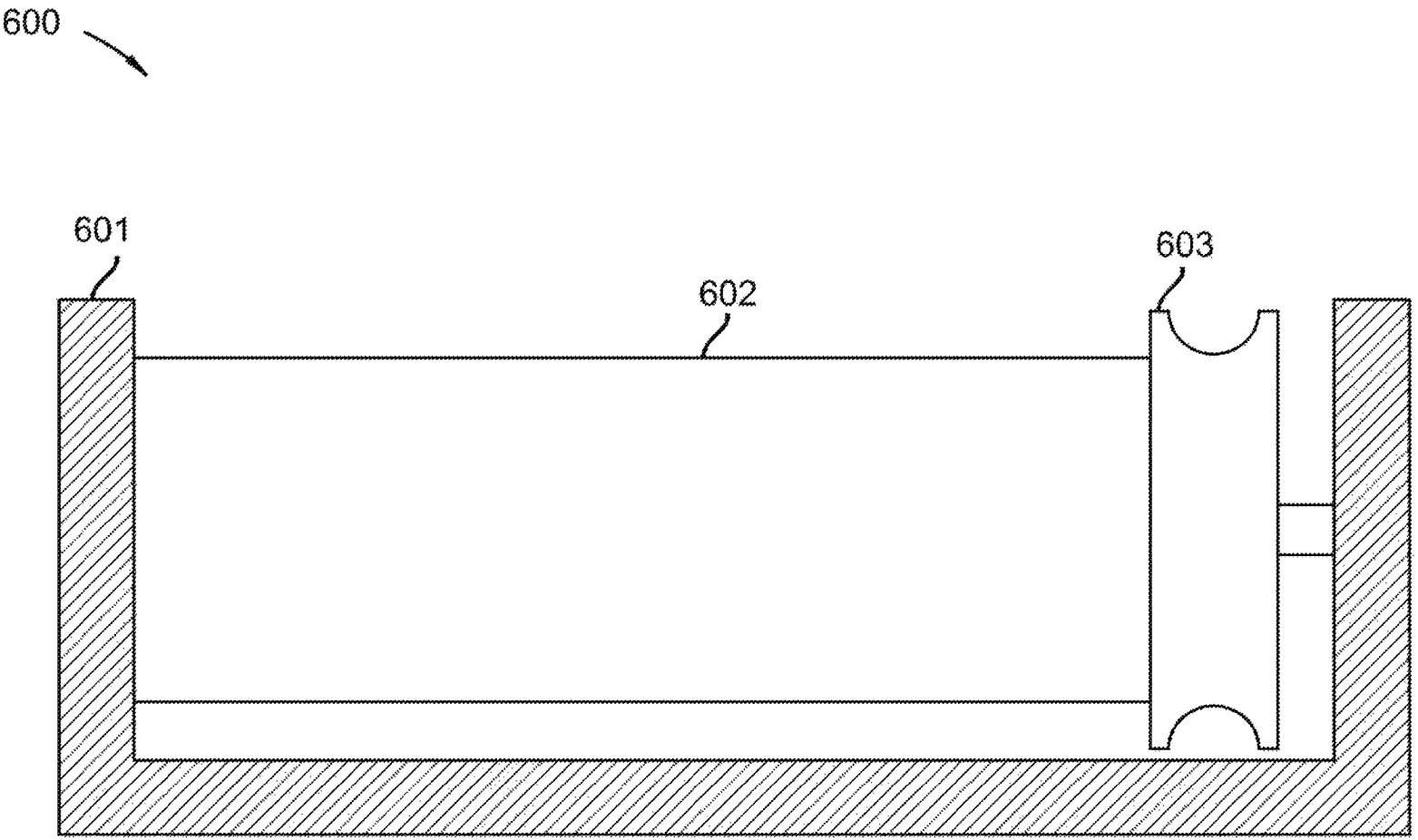
FIG. 6 depicts an embodiment of a tensioner motor disposed in a line guide, according to the claimed invention.

FIG. 6 depicts an embodiment of a tensioner motor disposed in a line guide, according to the claimed invention. Line guide 600 includes guide housing 601, tensioner motor 602, and tensioner 603. Line guide 600 is similar to the line guides described above, such as with regard to FIGS. 1A-B. Tensioner motor 602 and tensioner 603 are disposed within line guide housing 601. Line guide 600 is affixed to a winch such that it provides a counter force to tensioner motor 602, allowing tensioner motor 602 to transfer power to tensioner 603. In such an embodiment, motor 602 is powered in any of a variety of ways, such as via a winch motor, battery power, and/or solar power.

Figure 7:
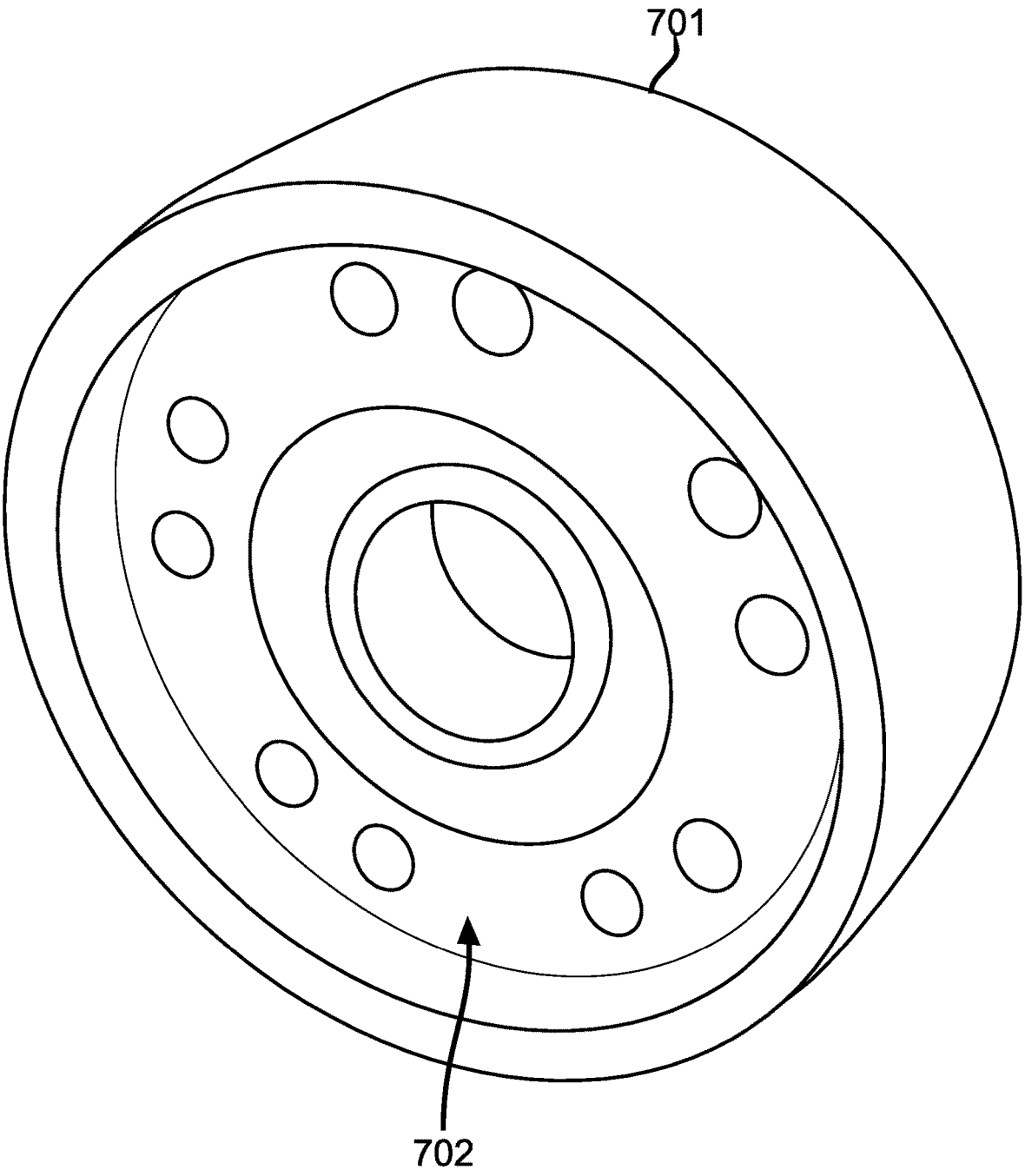
FIG. 7 depicts a tensioner having a one-way bearing.

FIG. 7 depicts a tensioner having a one-way bearing. In embodiments of a winch according to the claimed invention that include a tensioner gear driven by a drum gear, it is beneficial to include tensioner 701, which includes one-way bearing 702. One-way bearing 702 allows the tensioner gear to drive tensioner 701 at a faster linear speed than a payout speed of a line associated with the winch when the line is paying out, but also allows tensioner 701 to rotate freely, in many cases at the same linear speed as a spooling speed, when the line is being spooled. However, in some embodiments, a motor rotates tensioner 701 in a direction opposite of the winch drum as the line is spooled onto the drum to maintain tension while spooling. In some similar embodiments not depicted, one-way gear 702 is positioned in the tensioner gear.

Figure 8:
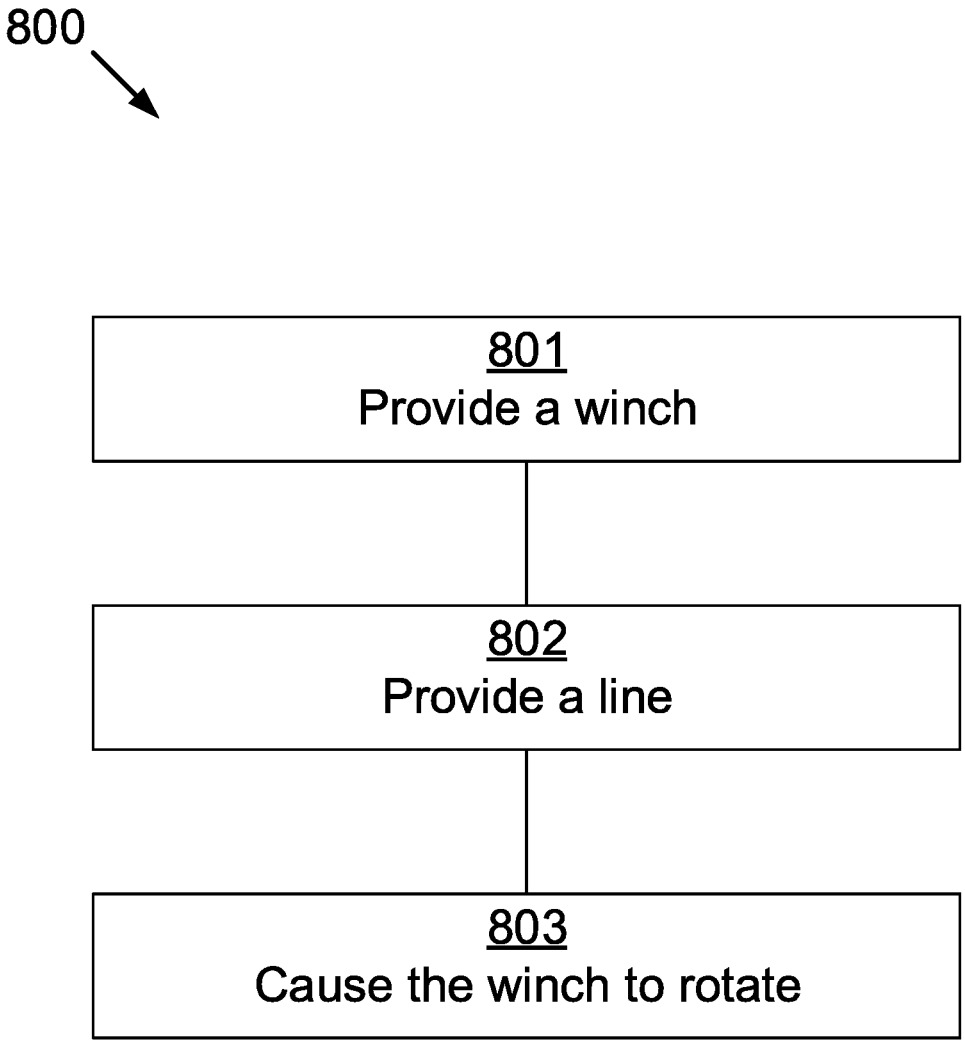
FIG. 8 depicts a method of using a winch according to the claimed invention.

FIG. 8 depicts a method of using a winch according to the claimed invention. Method 800 includes, at block 801, providing a winch. The winch is similar to those winch embodiments described above with regard to FIGS. 1A-7, and includes a drum that draws in and lets out a line, a motor and transmission that apply torque to the drum, and a tensioner positioned adjacent to the drum. When the line passes between the tensioner and drum, the line is in frictional contact with the tensioner and drum. Additionally, the tensioner rotates with a linear speed exceeding a linear speed of the drum as the line is let out from the drum, and rotates freely as the line is drawn in. At block 802, a line is provided, which passes between the tensioner and the drum. At block 803, the winch is caused to rotate. In one embodiment, causing the winch to rotate pays out the line from the drum. In such an embodiment, the frictional engagement of the tensioner with the line, and the linear speed of the tensioner, ensure the line remains tight on the drum, preventing the line from backing off the drum and tangling. In another embodiment, causing the winch to rotate draws the line onto the drum. In such an embodiment, the tensioner rotates freely, or, in an alternative embodiment, with a linear speed slower than a spooling speed of the line.

Figure 9:
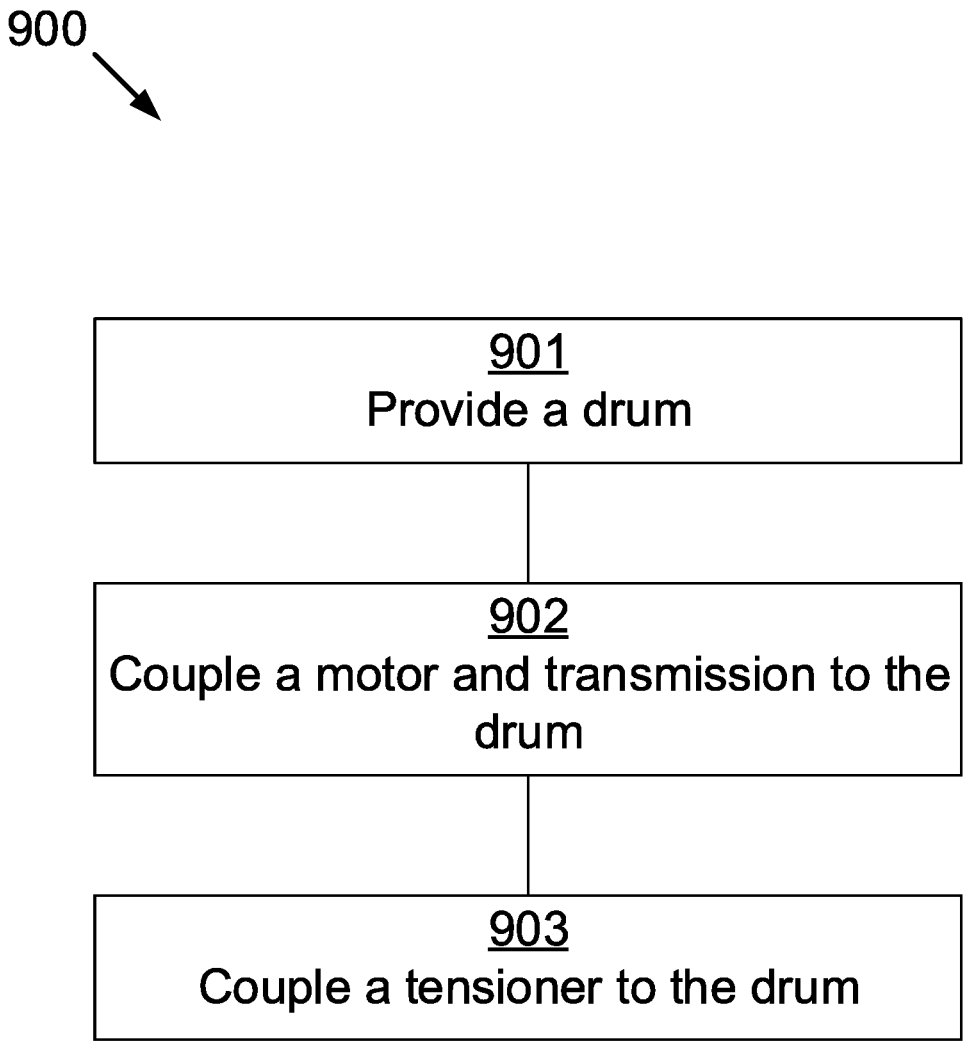
FIG. 9 depicts a method of making a winch according to the claimed invention.

FIG. 9 depicts a method of making a winch according to the claimed invention. Method 900 includes, at block 901, providing a drum. At block 902, a motor and transmission are coupled to the drum such that the motor and transmission apply torque to the drum. In some embodiments, the motor and transmission are positioned at least partially within the drum. For example, in one embodiment, the motor and transmission are positioned fully within the drum. At block 903, a tensioner is also coupled to the drum, such that when a line passes between the tensioner and drum, the line is in frictional contact with the tensioner and drum, and such that the tensioner rotates with a linear speed exceeding a linear speed of the drum as the line is let out from the drum, and such that the tensioner rotates freely as the line is drawn in.

We claim:

1. A winch, comprising:

a drum that draws in and lets out a line;

a motor and transmission that apply torque to the drum; and a tensioner positioned adjacent to the drum such that when the line passes between the tensioner and drum, the line is in frictional contact with the tensioner and drum, wherein the tensioner rotates with a linear speed exceeding a linear speed of the drum as the line is let out from the drum such that the line is pulled tight around the drum as the line pays out, and wherein the tensioner rotates freely as the line is drawn in; wherein the tensioner is driven by a tensioner motor; winch microcontroller wired to the winch motor; a tensioner microcontroller wired to the tensioner motor; wherein the winch microcontroller reads a rotation rate of the winch drum and communicates the rotation rate to the tensioner microcontroller; using stored data the tensioner microcontroller uses the rotation rate of the winch drum to determine a rotation rate of tensioner that results in a linear speed of tensioner greater than the linear speed of the drum as the line is let out from the drum.

2. The winch of claim 1, wherein the tensioner comprises a one-way bearing.

3. The winch of claim 1, wherein the motor and transmission are contained at least partially within the drum.

4. The winch of claim 3, wherein the motor and transmission are fully contained within the drum.

5. The winch of claim 1, wherein the drum comprises a gear that engages a tensioner gear.

6. The winch of claim 4, further comprising a drum gear attached to the drum, and a tensioner gear attached to the tensioner, wherein the drum gear rotates at the same speed as the drum, and wherein the tensioner gear rotates at the same speed as the tensioner.

7. The winch of claim 6, wherein the drum gear has a gear ratio with the tensioner gear ranging from 1.1 turns of the gear ration for every 1 turn of the drum gear, to 100 turns of the gear ratio for every 1 turn of the drum gear.

8. The winch of claim 6, wherein the drum gear has a gear ratio with the tensioner gear ranging from 1.1:1 to 25:1, 25:1 to 50:1, 50:1 to 75:1, 75:1 to 100:1, 1.1:1 to 10:1, 10:1 to 20:1, 20:1 to 30:1, 30:1 to 40:1, 40:1 to 50:1, 50:1 to 60:1, 60:1 to 70:1, 70:1 to 80:1, 80:1 to 90:1, or 90:1 to 100:1.

9. The winch of claim 1, wherein the tensioner comprises one or more of a wheel, a sphere, and a belt.

10. The winch of claim 8, wherein the tensioner wheel comprises a groove that fits around the line.

11. The winch of claim 1, wherein the tensioner motor is disposed within a line guide coupled to the winch.

12. A method of using a winch, comprising:

providing a winch, wherein the winch comprises a drum that draws in and lets out a line, a motor and transmission that apply torque to the drum, and a tensioner positioned adjacent to the drum such that when the line passes between the tensioner and drum, the line is in frictional contact with the tensioner and drum, wherein the tensioner rotates with a linear speed exceeding a linear speed of the drum as the line is let out from the drum, and wherein the tensioner rotates freely as the line is drawn in;

wherein the line passes between the tensioner and the drum; and causing the winch to rotate; wherein a tensioner motor for driving the tensioner; a winch microcontroller wired to the winch motor; a tensioner microcontroller wired to the tensioner motor; wherein the winch microcontroller reads a rotation rate of the winch drum and communicates the rotation rate to the tensioner microcontroller; using stored data the tensioner microcontroller uses the rotation rate of the winch drum to determine a rotation rate of tensioner that results in a linear speed of tensioner greater than the linear speed of the drum as the line is let out from the drum.

13. A method of making a winch, comprising:

providing a drum;

coupling a motor and transmission to the drum, wherein the motor and transmission apply torque to the drum; and coupling a tensioner to the drum, such that when a line passes between the tensioner and drum, the line is in frictional contact with the tensioner and drum, and such that the tensioner rotates with a linear speed exceeding a linear speed of the drum as the line is let out from the drum, and such that the tensioner rotates freely as the line is drawn in; wherein a tensioner motor for driving the tensioner; a winch microcontroller wired to the winch motor; a tensioner microcontroller wired to the tensioner motor; wherein the winch microcontroller reads a rotation rate of the winch drum and communicates the rotation rate to the tensioner microcontroller; using stored data the tensioner microcontroller uses the rotation rate of the winch drum to determine a rotation rate of tensioner that results in a linear speed of tensioner greater than the linear speed of the drum as the line is let out from the drum.

14. The method of claim 13, wherein the motor and transmission are positioned at least partially within the drum.

* * * * *